US007329128B1

(12) United States Patent
Awad

(10) Patent No.: US 7,329,128 B1
(45) Date of Patent: Feb. 12, 2008

(54) CABLE CONNECTOR

(75) Inventor: Ramy Awad, Seffner, FL (US)

(73) Assignee: The General Electric Company, Schenectady, NY (US)

( * ) Notice: Subject to any disclaimer, the term of this patent is extended or adjusted under 35 U.S.C. 154(b) by 0 days.

(21) Appl. No.: 11/698,361

(22) Filed: Jan. 26, 2007

(51) Int. Cl.
*H01R 11/30* (2006.01)

(52) U.S. Cl. ..... 439/38

(58) Field of Classification Search ..... 439/38, 439/39, 40

See application file for complete search history.

(56) References Cited

U.S. PATENT DOCUMENTS 4,844,582 A * 7/1989 Giannini ..... 385/57
5,015,061 A * 5/1991 Giannini ..... 385/56
6,464,509 B1 * 10/2002 Emberty et al. ..... 439/39
6,616,468 B2 * 9/2003 Sakiyama ..... 439/181

OTHER PUBLICATIONS

Apple MacBook Pro-Design, available at http://www.apple.com/macbookpro/design.html, last visited Mar. 16. 2007.

* cited by examiner

*Primary Examiner*—Tulsidas C. Patel
*Assistant Examiner*—Phuongchi Nguyen
(74) *Attorney, Agent, or Firm*—Andrus, Sceales, Starke & Sawall, LLP

(57) ABSTRACT

A cable connector is provided having a plug and a receptacle. Magnets are arranged on the plug and receptacle such that the magnets attract each other when the plug and receptacle are in a mated position and repel each other when the plug and receptacle are a predetermined distance away from the mated position. A cable connection system is provided that includes an adapter for connecting the plug and receptacle when only one of the plug and receptacle include magnets.

10 Claims, 4 Drawing Sheets

CABLE CONNECTOR

BACKGROUND

The present application relates generally to electrical connectors, such as serial, parallel and video port connectors. More particularly, this application relates to a cable connector and a cable connection system for safely connecting, maintaining, and disconnecting a correct physical and electrical connection between an electrical plug and a corresponding electrical receptacle.

Many known electrical connectors include fixed couplings between a plug and a receptacle. The plug has opposing screws that are adapted to fit into corresponding screw holes located on the receptacle. Some of these connectors include captive screws, which require the user to physically use a screw driver to secure the plug to the receptacle. Others include an integral knob or handle, which allows for manual turning of the screws. In use, these connectors are time consuming and cumbersome.

Another type of known electrical connector includes a plug and receptacle that fit together in a snap-fit or friction-fit engagement. This type of arrangement, while often easy to use, has many drawbacks. For example, the plug tends to "walk" out of the receptacle after a lateral load has been applied on the electrical cord or plug and then relieved. If the retention force of the snap-fit or friction-fit connection is too high, wires in the cable can become detached or severed when the plug is removed from the receptacle. If the retention force of the snap-fit connection is too low, a proper connection between the plug and receptacle is not maintained. Moreover, it is often found that consumers tend to force a plug into an incorrect receptacle, which in turns shears the electrical connectors in the plug.

There is a need in the art for a cable connector and a cable connection system that allows safe connection, maintenance, and disconnection of a correct physical and electrical connection between an electrical plug and a corresponding electrical receptacle.

SUMMARY

The present application describes a cable connector including a plug and a corresponding receptacle. Magnets strategically arranged on both the plug and receptacle generate an attractive force when the plug and receptacle are positioned in a mated position and a repelling force when the plug and receptacle are a positioned a predetermined distance away from the mated position.

A cable connection system includes an adapter for effectively mating a plug and receptacle. The adapter has a face that is arranged to mate with the plug in a mating position and a face that is arranged to mate with the receptacle. Either the first or second mating face of the adapter, or both, can include magnets that are positioned to attract to corresponding magnets on a particular plug or receptacle.

BRIEF DESCRIPTION OF THE DRAWINGS

Preferred embodiments are provided in the drawings, which are briefly described herein below.

DETAILED DESCRIPTION OF THE DRAWINGS

Figure 1:
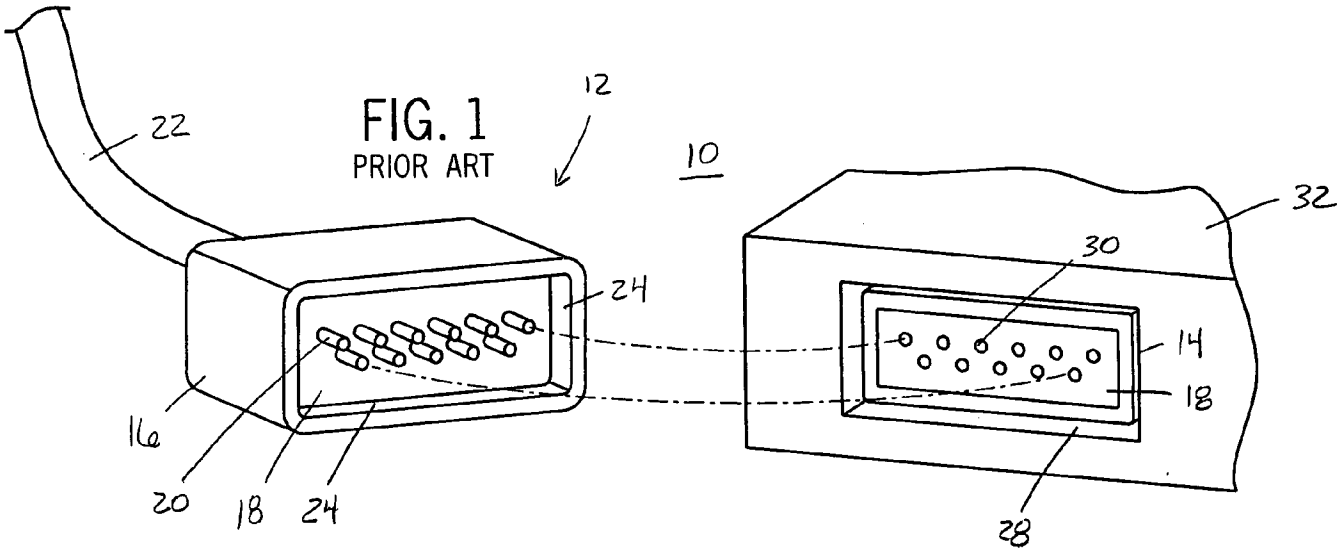
FIG. 1 PRIOR ART
FIG. 1 depicts a prior art connector.

FIG. 1 depicts a prior art cable connector 10 including a plug 12 and a receptacle 14. The plug 12 includes a housing 16, a mating face 18, and a plurality of aligned pin connectors 20 that are electrically connected to an electrical cord 22. The mating face 18 is slightly recessed in the housing 16 and surrounded by engagement walls 24, which are essentially a portion of the interior of housing 16. The receptacle 14 is sized and shaped to receive the plug 12 in a friction-fit or snap-fit connection. The receptacle 14 includes a mating face 18 surrounded by a recess 28 sized and shaped slightly smaller than the engagement walls 24 of the plug 12, to receive the engagement walls 24 in a friction-fit or snap-fit connection. The receptacle 14 also includes a plurality of aligned pin apertures or receptors 30 arranged to receive the pin connectors 20 of the plug 12 and thereby bridge an electrical connection between the receptacle 14 and the device 32 associated with the receptacle 14. Typically, the device 32 can include a computer or peripheral device, such as a printer, monitor, camera, projector, modem, or the like. It will be recognized by those skilled in the art that the present application is applicable with a wide variety of electronic devices, other than those specifically mentioned herein.

Figure 4:
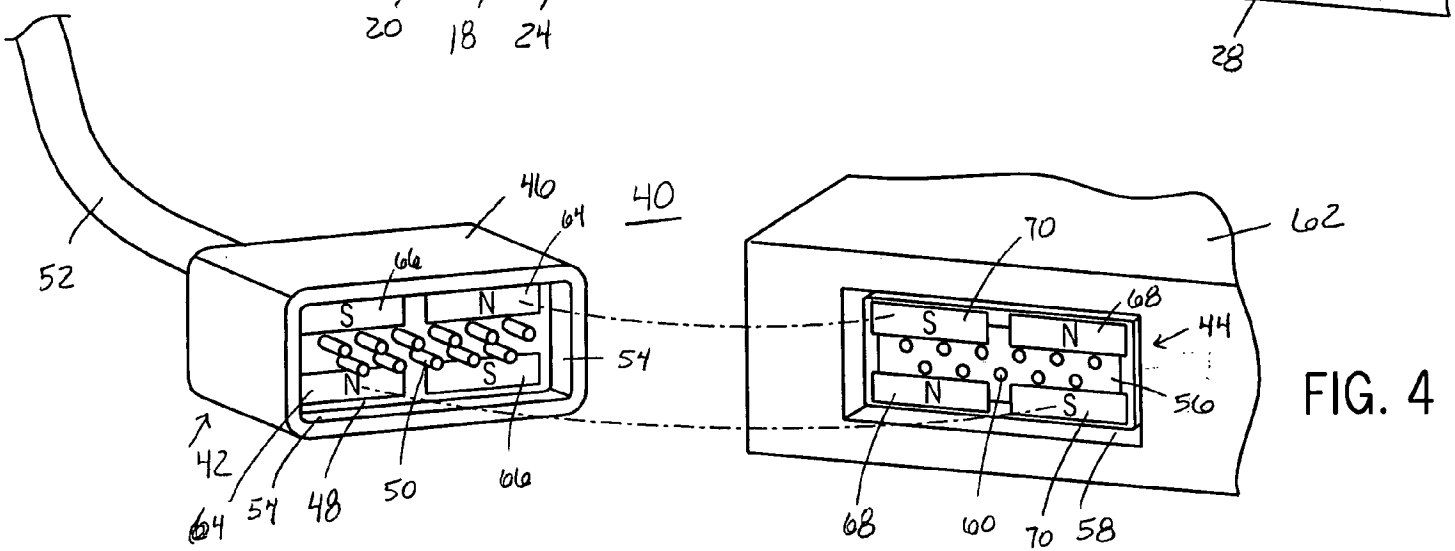
FIG. 4 depicts a perspective view of the cable connector of FIG. 2.
Figure 2:
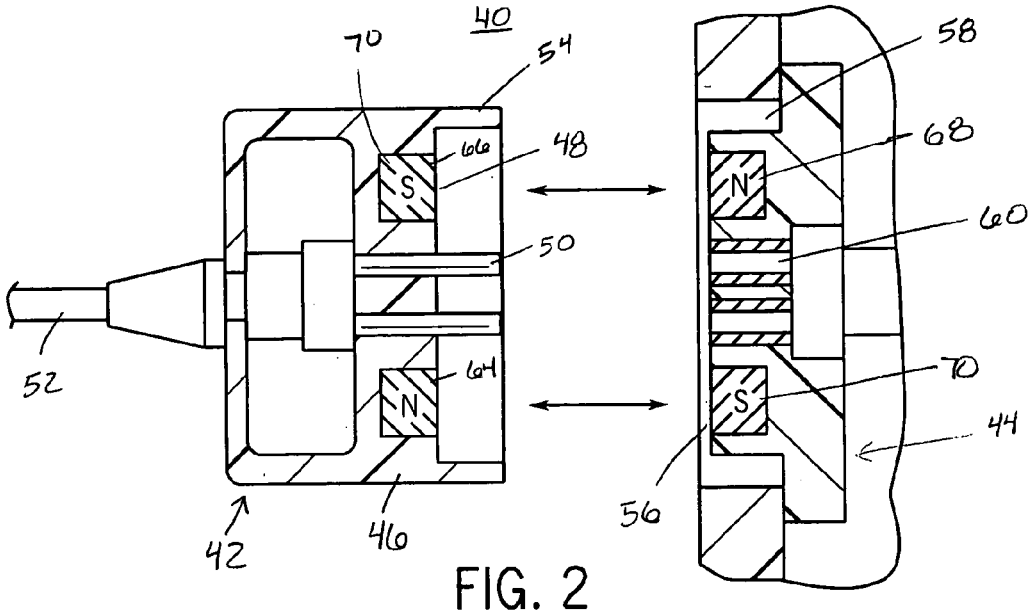
FIG. 2 depicts a side sectional view of a cable connector.
Figure 3:
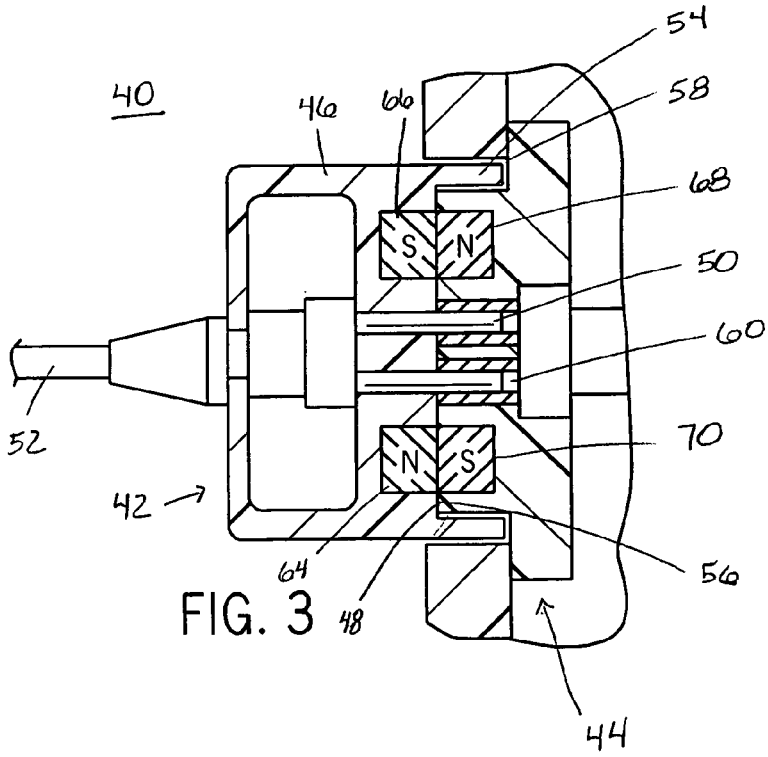
FIG. 3 depicts the cable connector of FIG. 2, in a mated position.

Referring to FIGS. 2-4, an improved cable connector 40 is shown. The cable connector 40 includes a plug 42 and receptacle 44. The plug 42 includes a housing 46, a mating face 48, and a plurality of pin connectors 50 that extend from the mating face 48 and are electrically connected to an electrical cord 52. In the embodiments shown, the mating face 48 is slightly recessed in the housing 46 and surrounded by engagement walls 54, which are essentially a portion of the housing 46. The receptacle 44 is sized and shaped to receive the plug 42 in a friction fit or snap fit connection. More specifically, the receptacle 44 includes a mating face 56 surrounded by a recess 58 sized and shaped slightly smaller than the engagement walls 54 of the plug 42, to receive the engagement walls 54 in a friction-fit or snap-fit connection. According to the invention, the recess 58 and the engagement walls 54 are optional structures and are not necessary to accomplish the objects of the invention. The receptacle 44 also includes a plurality of aligned pin apertures or receptors 60 arranged to receive the pin connectors 50 of the plug 42 and bridge an electrical connection between the receptacle 44 and the device 62 associated with the receptacle 44. Typically, the device 62 can include a computer or peripheral device, such as a printer, monitor, camera, projector, modem, or the like. It will be recognized by those skilled in the art that the present invention is applicable with a wide variety of electronic devices, other than those specifically mentioned herein.

Magnets 64, 66 are provided on the plug 42 and magnets 68, 70 are provided on the receptacle 44. When the plug 42 and receptacle 44 are oriented in a mated position, see FIGS. 3 and 4, the opposite poles of magnets 64, 66 and 68, 70 are attracted to each other to encourage a connection between the plug 42 and receptacle 44 and encourage correct alignment between the pin connectors 50 and pin receptors 60. More specifically, the magnets 64 on the plug 42 have their respective north pole directed outward on the mating face 56. The magnets 66 on the plug have their respective south pole directed outward on the mating face 56. In corresponding positions on the receptacle mating face 56, magnets 68 have their north pole directed outwards and magnets 70 have their south pole directed outwards. When the plug 42 is brought within a certain distance from the receptacle 44, the opposite poles of magnets 64 and magnets 70 are attracted to each other. Similarly, the opposite poles of magnets 66 and magnets 68 are attracted to each other. Thereby, a proper physical and electrical connection is encouraged between the plug 42 and receptacle 44 and the pin connectors 50 and pin receptors 60.

The magnets on the plug and adapter can comprise a strong enough attraction force to maintain a proper electrical/physical connection between the plug and receptacle, and a weak enough attraction force to prevent severing of a wire connection inside a cable connected to the plug or receptacle when the plug and receptacle are separated. The example described herein provides a durable and simple arrangement having few parts that will wear down over time.

Figure 5:
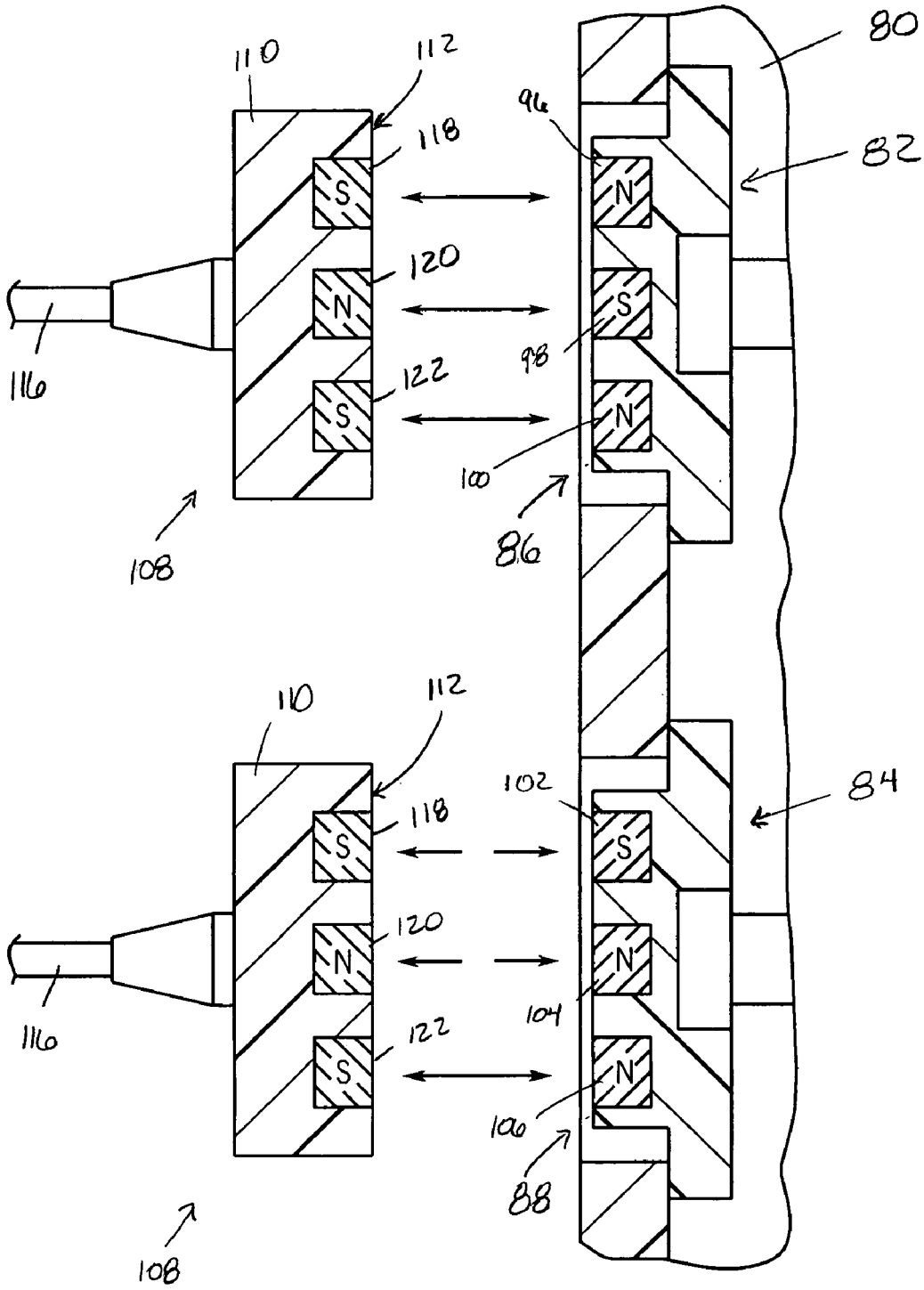
FIG. 5 depicts a side sectional view of a cable connection system.

Advantageously, when the plug 42 and receptacle 44 are not properly aligned, like poles of the magnets 64, 68 and 66, 70 repel each other and thus discourage improper connection between the plug 42 and the receptacle 44. Referring to FIG. 5 a single device 80 can include several receptacles that are intended to receive different plugs for different functions. In such an arrangement, each matching plug and receptacle, respectively, can be provided with magnets strategically positioned on the plug and receptacle so that the opposite poles of the magnets on the plug and receptacle, respectively, are aligned in the mated position. Because the arrangement and/or number of magnets on each plug/receptacle combination is unique, an improper connection between an unrelated plug and receptacle is discouraged. That is, if a user attempts to insert a plug into an improper receptacle, opposing poles of the magnets will not align and there will not be sufficient attractive force to encourage connection. Further, if the respective magnets on the plug and receptacle are not aligned, the like poles will repel each other, thus discouraging an improper connection.

As shown in FIG. 5, a device 80 includes a first receptacle 82 and a second receptacle 84. Each receptacle is sized and shaped to receive a plug and includes a mating face 86, 88. The first and second receptacles 82, 84 are similar to the receptacle 44 shown in FIGS. 2-4. It will be recognized by those skilled in the art that the particular receptacle embodiment can vary within the scope of the present invention. The first and second receptacles 82, 84 are shown schematically, but it will be understood that the receptacles could include a plurality of aligned pin apertures or receptors arranged to receive pin connectors of a particular plug and thereby bridge an electrical connection between the receptacle 82, 84 and the intended plug, as shown in the other embodiments herein. Typically, the device 80 can include a computer or peripheral device, such as a printer, monitor, camera, projector, modem or the like. It will be recognized by those skilled in the art that the present application is applicable to a wide variety of electronic devices, other than those specifically mentioned.

As shown in FIG. 5, the first receptacle 82 includes a first magnet 96, a second magnet 98, and a third magnet 100. The first magnet 96 has its north pole oriented outward on the mating face 86. The second magnet 98 has its south pole oriented outward on the mating face 86. The third magnet 100 has its north pole oriented outward on the mating face 86. The second receptacle 84 includes a first magnet 102, a second magnet 104, and a third magnet 106. The first magnet 102 has its south pole oriented outward on the mating face 88. The second magnet 104 has its north pole oriented outward on the mating face 88. The third magnet 106 has its north pole oriented outward on the mating face 88.

FIG. 5 also depicts a plug 108 having a housing 110 and a mating face 112. The plug 108 is shown schematically, but it will be understood that the plug 108 may include a plurality of aligned pin connectors that are electrically connected to the electrical cord 116. The pin connectors would be positioned on the mating face 112 of the plug 108 such that when the plug 108 and first receptacle 82 are placed in a mating position, the pin connectors are received in receptors and an electrical connection is established between the device 80 and the electrical cord 116, similar to the embodiments discussed above.

Magnets 118, 120, 122 are provided on the plug 108. The first magnet 118 has its south pole outwardly oriented on the mating face 112. The second magnet 120 has its north pole pointed outward on the mating face 112. The third magnet 122 has its south pole oriented outward on the mating face 112.

As shown in FIG. 5, when the plug 108 and first receptacle 82 are positioned approximate each other, the magnets 118, 120, 122 on the plug 108 are attracted to the magnets 96, 98, 100 on the first receptacle 82. More specifically, the south pole on the first magnet 118 is directed to the north pole on the second magnet 96. The north pole on the second magnet 120 is attracted to the south pole on the second magnet 98. The south pole on the third magnet 122 is attracted to the north pole on the third magnet 100. As such, connection between the plug 108 and first receptacle 82 is encouraged.

As further shown in FIG. 5, connection between the plug 108 and an incorrect receptacle, namely the second receptacle 84 is discouraged. More specifically, when the plug 108 is placed proximate the second receptacle 84, the magnets 118, 120 on the plug 108 repel from the first magnet 102 and second magnet 104 on the second receptacle 84. More specifically, the outwardly directed south pole on the first magnet 118 repels with the outwardly directed south pole on the first magnet 102. The outwardly directed north pole on the second magnet 120 repels from the outwardly directed north pole on the second magnet 104. As such, connection between the plug 108 and second receptacle 84 is discouraged, thus preventing an improper plug connection.

Figure 6:
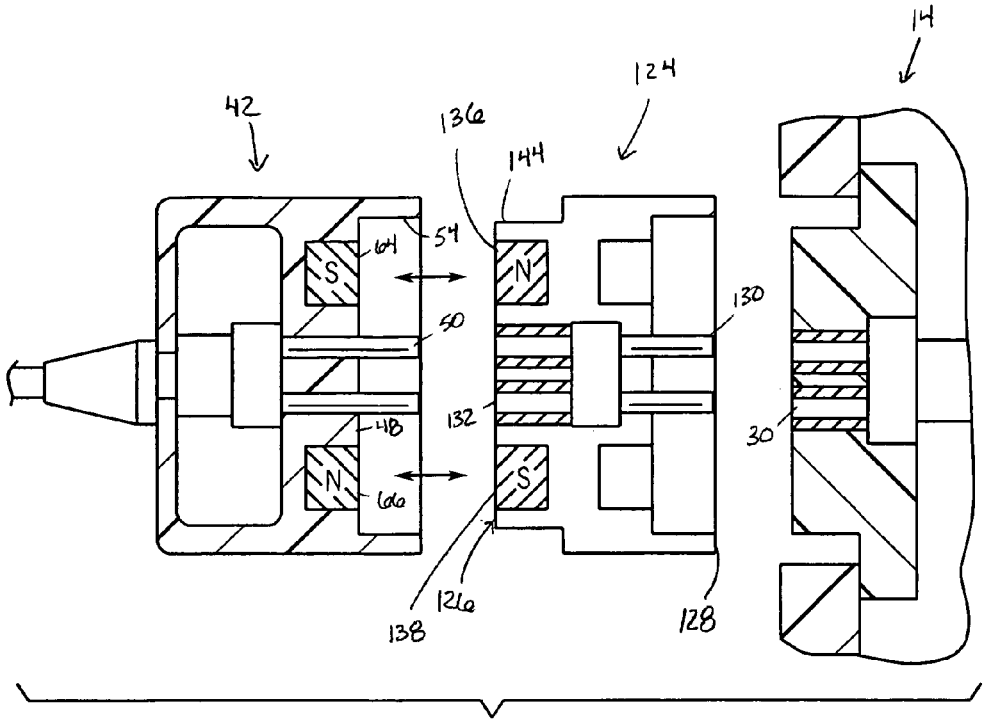
FIG. 6 depicts a side sectional view of another cable connection system.
Figure 7:
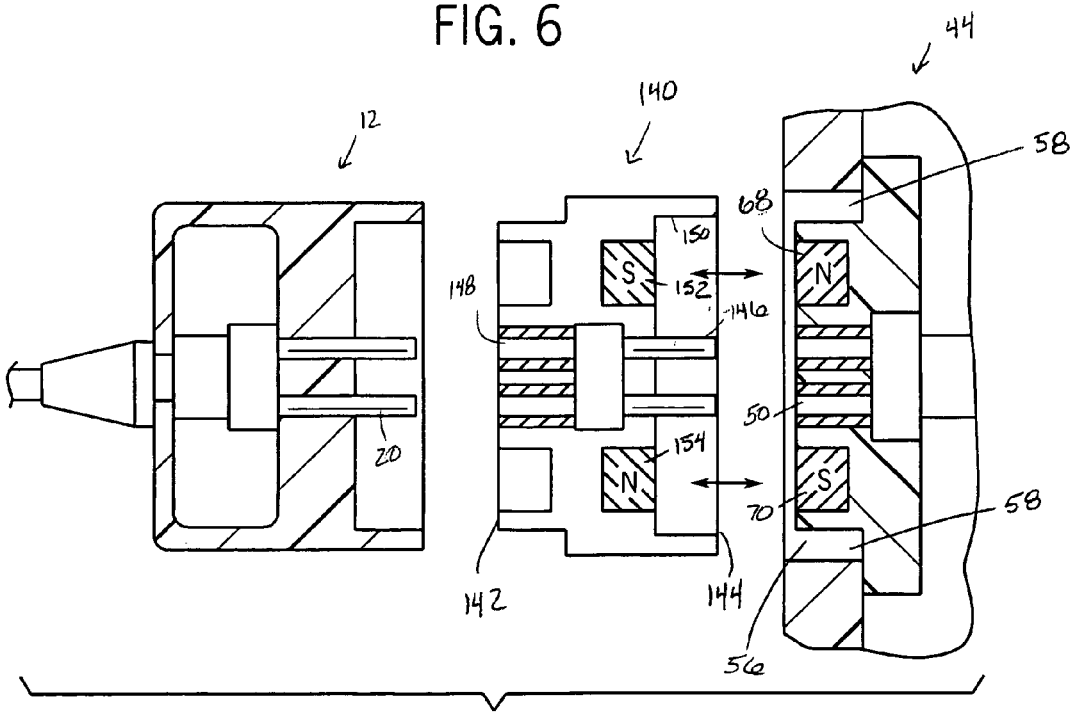
FIG. 7 depicts a side sectional view of another cable connection.

Referring to FIGS. 6 and 7, cable connection systems are shown. In FIG. 6, the cable connection system includes an adapter 124 for interconnecting the plug 42 and a receptacle 14. The plug 42 includes the attributes of the plug shown in FIGS. 2-4 and described herein above. The receptacle 14 includes the attributes of a known receptacle, shown in FIG. 1 and described herein above.

The adapter 124 includes opposing mating faces 126, 128. The mating face 128 is arranged to mate with the receptacle 14 in a known manner. More specifically, the mating face 128 includes aligned pin connectors 130 sized, shaped and positioned to mate with pin receptors 30 on the receptacle 14. The mating face 126 of the adapter 124 is arranged to mate with the plug 42. The mating face 126 includes pin receptors 132 sized, shaped and aligned to receive pin connectors 50 on plug 42. The mating face 126 also includes a narrowed outer edge 144 such that the mating face 126 fits within engagement walls 54 of the plug 42 in a snap-fit or friction-fit connection.

The mating face 126 also includes first and second magnets 136, 138. The first magnet 136 has its north pole directed outward on the mating face 126 and the second magnet 138 has its south pole directed outward on the mating face 126. As such, when the mating face 126 of the adapter 124 is placed proximate the mating face 48 of the plug 42, the first magnet 136 is attracted to the first magnet 64 on the plug 42 and the second magnet 138 is attracted to the second magnet 64 on the plug 66. A proper connection between the plug and adapter is therefore encouraged. It will also be recognized by those skilled in the art that the adapter facilitates connection of the plug 42 to a known or conventional receptacle 14.

It is possible to vary the number and positioning of the magnets from that depicted in the drawings and described above. In this manner, the present application provides a simple way to verify a correct match between a plug and connector that are intended to be connected.

In FIG. 7, the cable connection system includes an adapter 140 where interconnecting the plug 12 and a receptacle 44. The plug 12 includes the attributes of a known plug, shown in FIG. 1 and described herein above. The receptacle 44 includes the attributes of the receptacle shown in FIGS. 2-4 and described herein above.

The adapter 140 includes opposing mating faces 142, 144. The mating face 142 is arranged to mate with the plug 12 in a known manner. More specifically, the mating face 142 includes aligned pin receptors 148 sized, shaped and positioned to mate with pin connectors 20 on the plug 12. The mating face 144 of the adapter 140 is arranged to mate with receptacle 44. The mating face 144 includes pin connectors 146 sized, shaped and aligned to mate with pin receptors 50 on receptacle 44. The mating face 144 also includes outer engagement walls 150 such that the mating face 144 engages with recess 58 on receptacle 44 in a snap-fit or friction-fit connection.

The mating face 144 also includes first and second magnets 152, 154. The first magnet 152 has its south pole directed outward on the mating face 144 and the second magnet 154 has its north pole directed outward on the mating face 144. As such, when the mating face 144 of the adapter 140 is placed proximate the mating face 56 of the receptacle 44, the first magnet 152 is attracted to the first magnet 68 on the receptacle 44 and the second magnet 154 is attracted to the second magnet 70 on the receptacle 44. A proper connection between the plug and adapter is therefore encouraged. It will also be recognized by those skilled in the art that the adapter facilitates connection of the receptacle 44 to a known or conventional plug 12.

It is possible to vary the number and positioning of the magnets from the depiction in the drawings and described above. In this manner, the present application provides a simple way to verify a correct match between a plug and connector that are intended to be connected.

While this invention is susceptible of embodiments of many different forma, the drawings shown in the specification describes in detail a preferred embodiment of the invention. It should be understood that the drawings and specification are to be considered and exemplification of the principles of the invention. They are not intended to limit the broad aspects of the invention to the embodiments illustrated.

What is claimed is:

1. A cable connection system comprising:

a plug;

a receptacle;

an adapter having a first mating face that is arranged to receive and mate with the plug in a mated position and a second mating face arranged to mate with the receptacle, wherein the adapter effectively connects the plug to the receptacle;

a first magnet arranged on the plug and having a first pole directed towards the adapter when the plug and adapter are in the mated position;

a second magnet arranged on the plug and having a second pole directed towards the adapter when the plug and adapter are in the mated position, the second pole being different from the first pole;

a third magnet arranged on the first mating face of the adapter and having the first pole directed towards the second magnet when the plug and adapter are in the mated position; and a fourth magnet arranged on the first mating face of the adapter and having the second pole directed towards the first magnet the when the plug and adapter are in the mated position;

wherein the first and second magnets on the plug are attracted to the third and fourth magnets on the adapter, respectively, when the plug and adapter are located in the mated position.

2. The cable connector of claim 1, wherein the plug comprises a mating face and the first magnet and second magnet are arranged on the plug mating face.

3. The cable connector of claim 1, wherein the receptacle comprises a mating face and the third magnet and fourth magnet are arranged on the receptacle mating face.

4. The cable connector of claim 1, comprising an electrical cord attached to the cable connector and wherein the magnets generate an attractive force that is less than a force required to sever an electrical pathway of the electrical cord.

5. The cable connector of claim 1, wherein the attractive force is large enough to support physical connection between the plug and adapter, but small enough to prevent damage to the plug or adapter when the plug and adapter are physically separated.

6. A cable connection system comprising:

a plug;

a receptacle;

an adapter having a first mating face that is arranged to receive and mate with the plug in a mated position and a second mating face arranged to mate with the receptacle, wherein the adapter effectively connects the plug to the receptacle;

a first magnet arranged on the receptacle and having a first pole directed towards the adapter when the receptacle and adapter are in the mated position;

a second magnet arranged on the receptacle and having a second pole directed towards the adapter when the receptacle and adapter are in the mated position, the second pole being different from the first pole;

a third magnet arranged on the second mating face of the adapter and having the first pole directed towards the second magnet when the receptacle and adapter are in the mated position; and a fourth magnet arranged on the second mating face of the adapter and having the second pole directed towards the first magnet the when the receptacle and adapter are in the mated position;

wherein the first and second magnets on the receptacle are attracted to the third and fourth magnets on the adapter, respectively, when the receptacle and adapter are located in the mated position.

7. The cable connector of claim 6, wherein the plug comprises a mating face and the first magnet and second magnet are arranged on the plug mating face.

8. The cable connector of claim 6, wherein the receptacle comprises a mating face and the third magnet and fourth magnet are arranged on the receptacle mating face.

9. The cable connector of claim 6, comprising an electrical cord attached to the cable connector and wherein the magnets generate an attractive force that is less than a force required to sever an electrical pathway of the electrical cord.

10. The cable connector of claim 6, wherein the attractive force is large enough to support physical connection between the receptacle and adapter, but small enough to prevent damage to the receptacle or adapter when the receptacle and adapter are physically attached.

* * * * *